US007137168B2

(12) United States Patent
Mann

(10) Patent No.: US 7,137,168 B2
(45) Date of Patent: Nov. 21, 2006

(54) PAINT ROLLER GRID

(75) Inventor: David G. Mann, Shreve, OH (US)

(73) Assignee: The Wooster Brush Company, Wooster, OH (US)

( * ) Notice: Subject to any disclaimer, the term of this patent is extended or adjusted under 35 U.S.C. 154(b) by 93 days.

(21) Appl. No.: 10/643,626

(22) Filed: Aug. 19, 2003

(65) Prior Publication Data

US 2005/0039294 A1 Feb. 24, 2005

(51) Int. Cl.
*B05C 21/00* (2006.01)

(52) U.S. Cl. ..... 15/257.06; 220/570; 220/697; 220/699; 220/700; 220/735; D32/53.1

(58) Field of Classification Search ..... 15/257.05, 15/257.06; 220/570, 697, 699–701, 735, 220/736; D32/53.1, 54
See application file for complete search history.

(56) References Cited

U.S. PATENT DOCUMENTS

| | | | | |
|---|---|---|---|---|
| 2,659,917 | A | 11/1953 | Drum | 15/257.06 |
| 2,893,030 | A * | 7/1959 | Averna | 15/257.06 |
| 3,110,921 | A | 11/1963 | Conner | |
| 3,394,425 | A * | 7/1968 | Welt | 15/257.06 |
| 3,409,931 | A | 11/1968 | Graf | |
| 3,493,988 | A | 2/1970 | Tidwell | |
| 3,576,045 | A * | 4/1971 | Stafford | 15/257.06 |
| 3,940,824 | A | 3/1976 | Gioia et al. | |
| 4,083,466 | A | 4/1978 | McManaway | |
| 4,145,789 | A | 3/1979 | Morgan, Sr. | |
| 4,200,949 | A | 5/1980 | Heniff, Jr. | 15/257.06 |
| D264,147 | S | 5/1982 | Heath | D32/54 |
| 4,756,046 | A | 7/1988 | Surface et al. | 15/257.06 |
| 4,865,282 | A | 9/1989 | Yonkman et al. | 248/111 |
| 5,123,576 | A | 6/1992 | Lawrence | 222/570 |
| 5,283,928 | A | 2/1994 | Linn et al. | 15/257.06 |
| 5,695,098 | A | 12/1997 | King | 224/148.7 |
| 5,727,708 | A | 3/1998 | Erickson | 220/23.87 |
| 5,810,196 | A | 9/1998 | Lundy | 220/736 |
| 6,119,303 | A | 9/2000 | Passafiume | 15/257.06 |
| 2004/0049876 | A1 * | 3/2004 | Bukovitz et al. | 15/257.06 |

* cited by examiner

*Primary Examiner*—Mark Spisich
(74) *Attorney, Agent, or Firm*—Renner, Otto, Boisselle & Sklar, LLP

(57) ABSTRACT

Paint roller grid includes a pair of hooks each including a rearwardly extending upper portion and a downwardly extending inturned lip having a forwardly facing inwardly angled surface for engaging an outer cylindrical surface of a container below the container rim when the hooks are hooked over the container rim and the grid is inserted into the top opening of the container. The hooks may be spaced from a bottom edge of the grid a distance slightly greater than the height of the container, whereby when the grid is inserted into the container opening and the hooks are hooked over the container rim, the bottom edge of the grid will engage the inside bottom surface of the container. A pair of feet may extend rearwardly from the grid for engagement with the inner cylindrical surface of the container to prevent the grid from moving within the container during rolling of a roller cover on the grid wiping surface.

15 Claims, 3 Drawing Sheets

PAINT ROLLER GRID

FIELD OF THE INVENTION

This invention relates to a paint roller grid that may be sized for mounting in a standard one-gallon paint can or similar size container for aiding in dispensing paint (or other liquid) more evenly over a paint roller cover.

BACKGROUND OF THE INVENTION

It is generally known to fit a paint roller grid into the open top of a one-gallon paint can or similar size container to provide a wiping surface above a quantity of paint in the container for aiding in dispersing the paint more evenly over the roller cover of a paint roller frame sized to fit within the container. As used herein, the term paint or paint roller cover means and includes paint, stain, sealer or other liquid coating suitable for application with a roller cover mounted on a roller frame.

One known paint roller grid of this type comprises a generally flat screen that is slightly taller than the paint can to provide the painter a place to grasp the grid to hold the grid in place while rolling excess paint from a roller cover. However, the grid has nothing to secure it in place within the container during the roll-off process. Thus the painter has to hold the grid in place with one hand, or possibly bend the grid to fit beneath the rim of the can to keep the grid in place without having to hold it during the roll-off process.

Other known types of paint roller grids include hooks at the top for hanging the grids over the top rim of a paint container. Also some known grids include bent portions that abut the inside surface of the container to keep the grids from pivoting when a roller is rolled against the grids.

However, there is a need for a paint roller grid that is more securely held in place within the container during the roll-off process.

SUMMARY OF THE INVENTION

The paint roller grid of the present invention includes hooks that more securely hold the grid in place within a container during the roll-off process. Also, the grid may be provided with rearwardly extending feet that engage the inner cylindrical surface of the container to prevent the grid from moving within the container during the roll-off process.

In accordance with one aspect of the invention, a pair of laterally spaced hooks extend rearwardly from the grid for hooking over an upper rim of a cylindrical container when the grid is inserted into a top opening of the container. Each of the hooks may include an inturned lip having a forwardly facing, inwardly angled surface for engaging an outer cylindrical surface of the container below the container rim when the hooks are hooked over the container rim.

In accordance with another aspect of the invention, the forwardly facing, inwardly angled surface of each of the hooks may have a concave curvature for engaging the outer cylindrical surface of the container below the container rim.

In accordance with another aspect of the invention, the hooks may be flexible, and the forwardly facing inwardly angled surface of each of the hooks may be spaced from respective side edges of the grid a distance less than the width of the container rim thus requiring the hooks to be flexed and press fitted over the container rim.

In accordance with another aspect of the invention, the hooks may have a slight interference fit with the outer cylindrical surface of the container when the hooks are hooked over the container rim, whereby the inturned lips of the hooks will remain in a slightly flexed state pressing against the outer cylindrical surface of the container below the container rim when the hooks are hooked over the container rim.

In accordance with another aspect of the invention, the hooks may be spaced from the bottom edge of the grid a distance slightly greater than the height of the container, whereby when the grid is inserted into the container top opening and the hooks are hooked over the container rim, the bottom edge of the grid will engage the inside bottom surface of the container for greater support.

In accordance with another aspect of the invention, a pair of laterally spaced feet may extend rearwardly from the grid for engagement with the inner cylindrical surface of the container to prevent the grid from moving within the container during the roll-off process.

In accordance with another aspect of the invention, the feet may extend rearwardly at a slight outward angle relative to the respective side edges of the grid and have outwardly facing outer ends that engage the inner cylindrical surface of the container.

In accordance with another aspect of the invention, the outer ends of the respective feet may be angled rearwardly and inwardly for making contact with the inner cylindrical surface of the container.

In accordance with another aspect of the invention, the outer ends of the respective feet may have a convex curvature for making increased contact with the inner cylindrical surface of the container.

In accordance with another aspect of the invention, the grid may extend outwardly beyond the hooks, whereby when the grid is inserted into the container top opening with the hooks hooked over the container rim, the grid will extend upwardly above the top of the container rim.

These and other objects, advantages, features and aspects of the invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
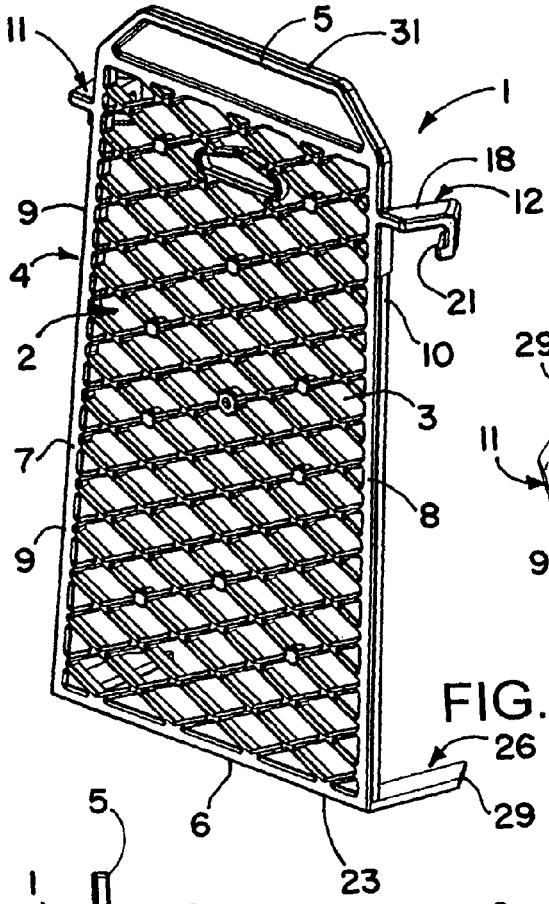
FIG. 1 is a perspective view of one form of paint roller grid in accordance with the present invention.
Figure 4:
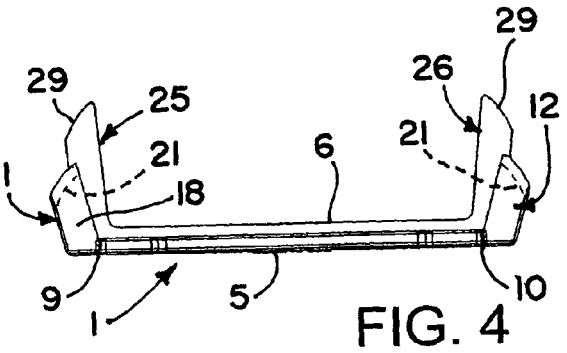
FIG. 4 is a top plan view of the paint roller grid.
Figure 3:
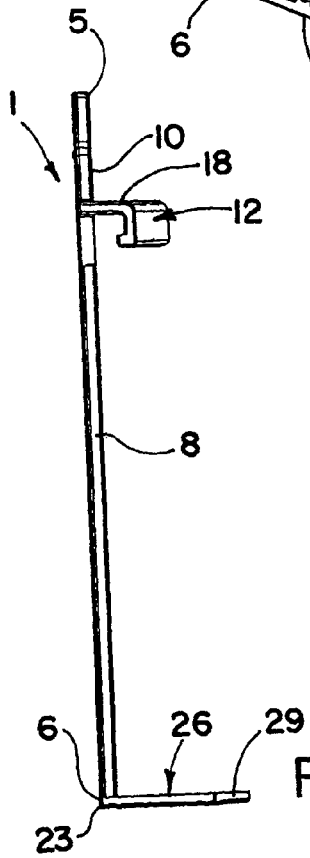
FIG. 3 is a side elevation view of the paint roller grid as seen from the right side of FIGS. 1 and 2.
Figure 2:
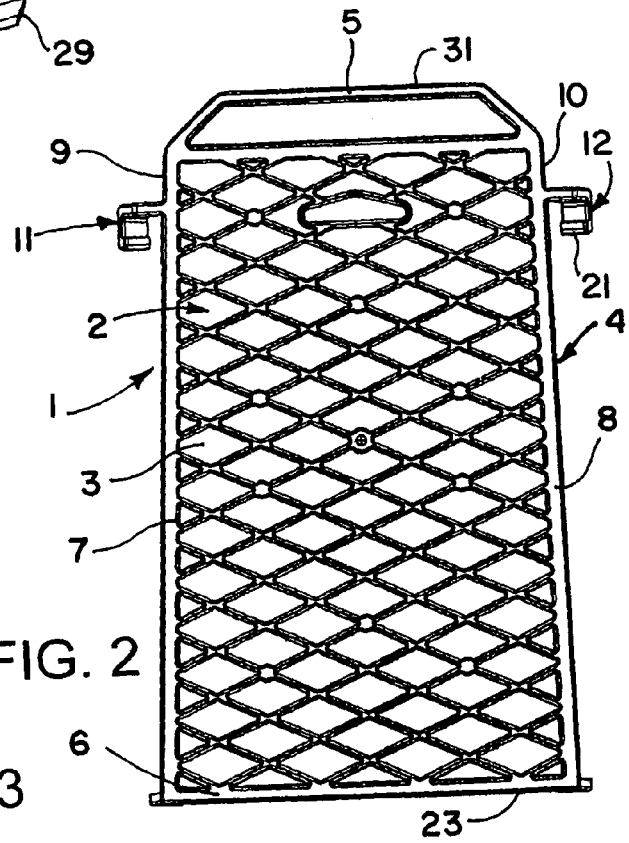
FIG. 2 is a front elevation view of the paint roller grid of FIG. 1.

Referring now in detail to the drawings, and initially to FIGS. 1–4, there is shown one form of paint roller grid 1 in accordance with the invention which may be integrally molded out of a suitable plastic material. The grid may be sized for mounting in a one-gallon paint can or similar size container to aid in dispersing paint (or other liquid) more evenly over a paint roller cover sized to be immersed in a supply of paint in the container and then rolled along the wiping surface 2 of the grid, as well known in the art. As previously indicated, the term paint or paint roller cover as used herein means and includes paint, stain, sealer or other liquid coating that is suitable for application with a roller cover mounted on a roller frame.

The grid wiping surface 2 may have a plurality of ridges or openings 3 of any desired shape for aiding in dispersing the paint more evenly over the roller cover and allowing any excess paint to drain back into the container during the roll-off process. Surrounding the wiping surface 2 is a frame 4 having upper and lower ends 5, 6 and opposite sides 7, 8.

Figure 5:
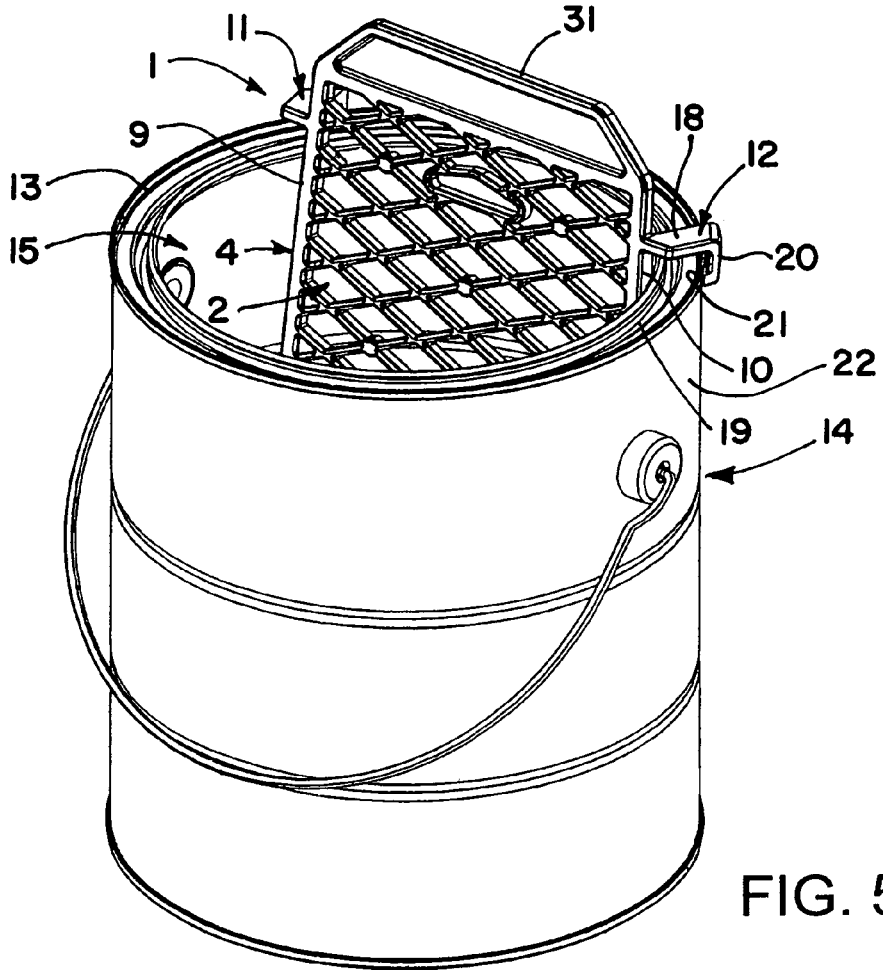
FIG. 5 is a schematic perspective view showing the paint roller grid inserted into the top opening of a one-gallon paint can or similar size container.
Figure 6:
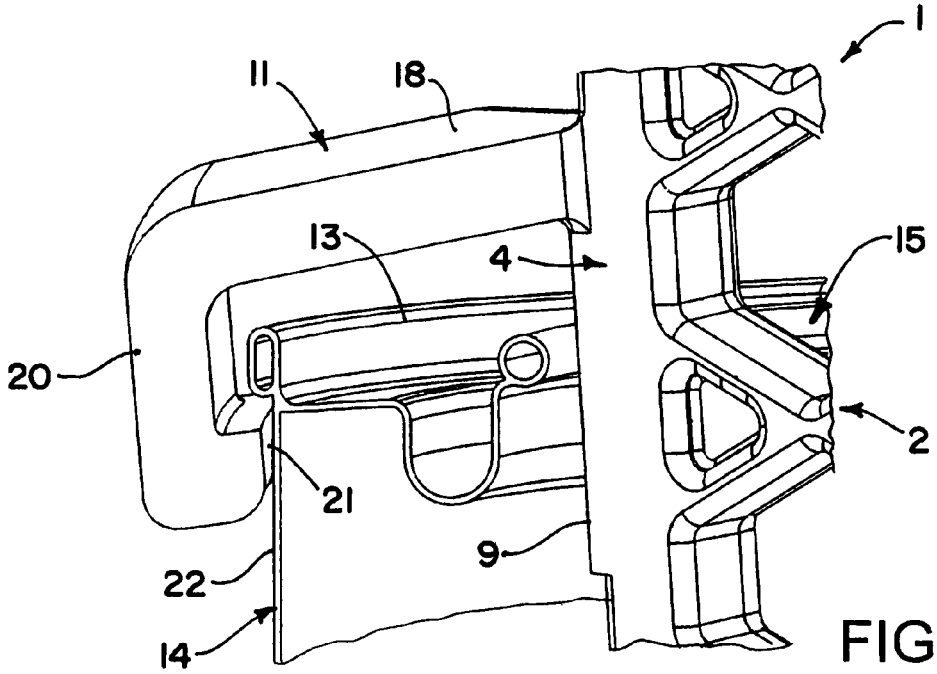
FIG. 6 is an enlarged fragmentary perspective view showing one of the hooks of the paint roller grid hooked over the upper rim of the container.

Protruding rearwardly from opposite side edges 9, 10 of the grid frame 4 are a pair of laterally spaced hooks 11, 12 for hooking over the upper rim 13 of a cylindrical container 14 when the grid is inserted into the top opening 15 of the container as shown in FIGS. 5 and 6. Each of the hooks 11, 12 includes a rearwardly extending portion 18 adapted to extend over the container rim 13 and a downwardly extending inturned lip 20 having a forwardly facing, inwardly angled surface 21 for engaging the outer cylindrical surface 22 of the container below the container rim when the hooks are hooked over the container rim.

The hooks 11, 12 are flexible, and the forwardly facing, inwardly angled surface 21 of each of the hooks is spaced from the respective side edges 9, 10 of the grid frame 4 a distance slightly less than the width of the container rim. This requires that the hooks be flexed and press fitted over the container rim, and results in a slight interference of the hooks with the outer cylindrical surface of the container rim, causing the hooks to remain in a slightly flexed state with the inwardly angled surfaces of the inturned lips pressing against the outer cylindrical surface of the container below the container rim.

The forwardly facing, inwardly angled surface 21 of each of the hooks may have a concave curvature (see FIGS. 4 and 6) for increased surface contact with the outer cylindrical surface of the container below the container rim. Further, the hooks may extend rearwardly at a slight outward angle from the respective side edges 9, 10 of the grid frame for ease of hooking over the container rim.

Preferably the rearwardly extending portion 18 of the hooks 11, 12 is spaced from the bottom edge 23 of the grid 4 a distance slightly greater than the height of the container 14. Accordingly, when the grid 1 is inserted into the container top opening 15 and the hooks are hooked over the container rim, the bottom edge of the grid will engage the inside bottom surface 24 of the container as seen in FIGS. 7 and 8 for increased stability of the grid during the roll-off process.

Figure 7:
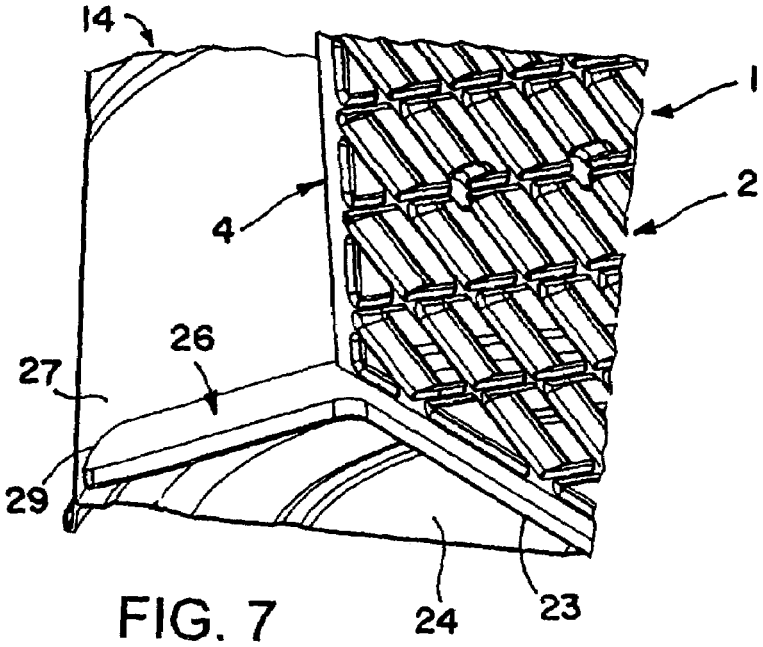
FIG. 7 is an enlarged fragmentary perspective view showing one of the legs of the paint roller grid engaging the inside cylindrical surface of the container.

To insure that the grid 1 does not move during the roll-off process, a pair of laterally spaced feet 25, 26 extend rearwardly from the bottom edge of the grid for engagement with the inside bottom surface 24 of the container and with the inner cylindrical surface 27 of the container as schematically shown in FIG. 7. Each of the feet may extend rearwardly at a slight outward angle relative to the respective side edges of the grid as shown in FIGS. 1–4. Also, each of the feet may have an outwardly facing outer end 29 that is angled rearwardly and inwardly for making contact with the inner cylindrical surface 27 of the container as shown in FIG. 7. Moreover, the outer end 29 of each of the feet may have a convex curvature for making increased contact with the inner cylindrical surface of the container as further shown in FIG. 7.

Figure 8:
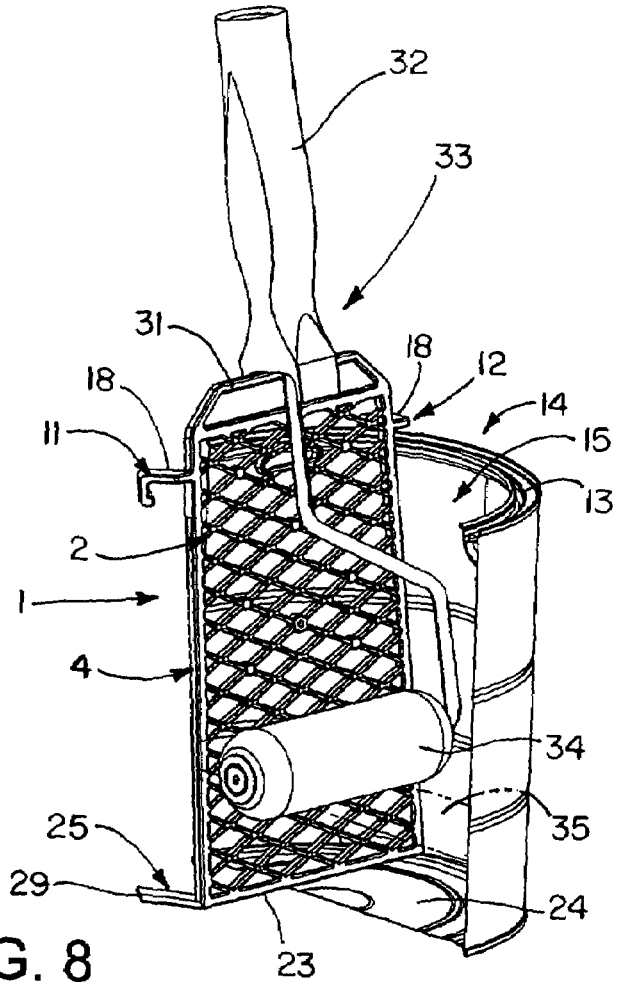
FIG. 8 is a fragmentary perspective view showing the bottom edge of the grid resting on the inside bottom surface of the container and the upper edge of the grid extending upwardly above the container rim for hooking of the handle of a roller frame over the grid upper edge with the roller frame extending into the container for supporting the roller cover above the level of paint in the container.

The grid 1 may extend outwardly beyond the hooks 11, 12, whereby when the grid is inserted into the container top opening 15 with the hooks hooked over the container rim 13, the grid will extend upwardly above the container rim as shown in FIGS. 5 and 8. This has the advantage of providing a longer wiping surface 2 for rolling a paint roller cover therealong. Also, the grid may extend a sufficient distance above the container rim to allow the handle 32 of a roller frame 33 to be hooked over the upper edge 31 of the grid with the roller frame extending into the container for supporting the roller cover 34 above the level 35 of paint in the container as further shown in FIG. 8, thereby reducing the amount of saturation of the roller cover when the roller frame is not in use. Of course, this assumes that the container is only partially filled with paint. Most professional painters, for example, work with a partially filled can of paint.

Although the invention has been shown and described with respect to a certain embodiment, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein exemplary embodiment of the invention. In addition, while a particular feature of the invention may have been disclosed with respect to only one embodiment, such features may be combined with one or more other features as may be desired and advantageous for any given or particular application.

What is claimed is:

1. A paint roller grid comprising a wiping surface for wiping a roller cover thereagainst, and a pair of laterally spaced hooks extending rearwardly from the grid for hooking over an upper rim of a cylindrical container when the grid is inserted into a top opening of the container, each of the hooks including a rearwardly extending upper portion adapted to extend over an upper surface of the container rim and a downwardly extending inturned lip having a forwarding facing, laterally inwardly angled surface for engaging an outer cylindrical surface of the container below the container rim when the hooks are hooked over the container rim, the forwarding facing, laterally inwardly angled surface of each of the hooks having a concave curvature for engaging the outer cylindrical surface of the container below the container rim.

2. The grid of claim 1 wherein the hooks extend rearwardly and laterally outwardly from opposite side edges of the grid for ease of hooking over the container rim.

3. The grid of claim 1 wherein the hooks are flexible, and the forwardly facing, laterally inwardly angled surface of each of the hooks is spaced from respective side edges of the grid a distance less than the width of the container rim thus requiring the hooks to be flexed and press fitted over the container rim.

4. The grid of claim 3 wherein the hooks have an interference fit with the outer cylindrical surface of the container when the hooks are hooked over the container rim, whereby the inturned lip of the hooks will remain in a slightly flexed state pressing against the outer cylindrical surface of the container below the container rim when the hooks are hooked over the container rim.

5. The grid of claim 1 wherein the hooks are spaced from a bottom edge of the grid a distance slightly greater than the height of the container, whereby when the grid is inserted into the container top opening and the hooks are hooked over the container rim, the bottom edge of the grid will engage an inside bottom surface of the container.

6. The grid of claim 5 further comprising a pair of laterally spaced feet extending rearwardly from a bottom edge of the grid for substantial flat engagement with the inside bottom surface of the container and with an inner cylindrical surface of the container to prevent the grid from moving within the container during rolling of a roller cover on the wiping surface.

7. The grid of claim 6 wherein the feet extend rearwardly at a slight outward angle relative to respective side edges of the grid and have outwardly facing outer ends that engage the inner cylindrical surface of the container.

8. The grid of claim 7 wherein the outer ends of the respective feet are angled rearwardly and inwardly for making contact with the inner cylindrical surface of the container.

9. A paint roller grid comprising a wiping surface for wiping a roller cover against the wiping surface, a frame extending completely around the wining surface, at least one hook extending rearwardly from the frame for hooking over an upper rim of a cylindrical container when the grid is inserted into a top opening of the container, and a pair of laterally spaced feet extending rearwardly from a bottom edge of the frame for engagement with an inner cylindrical surface of the container to prevent the grid from moving within the container during rolling of a roller cover on the wining surface, wherein the feet are rigidly affixed to the bottom edge of the frame and extend rearwardly at a slight outward angle relative to respective side edges of the frame and have outwardly facing outer ends that engage the inner cylindrical surface of the container, the outer ends of the respective feet are angled rearwardly and inwardly for making contact with the inner cylindrical surface of the container, and the outer ends of the respective feet have a convex curvature for making increased surface contact with the inner cylindrical surface of the container.

10. A paint roller grid comprising a wiping surface for wiping a roller cover against the wiping surface, a frame extending completely around the wining surface, at least one hook extending rearwardly from the frame for hooking over an upper rim of a cylindrical container when the grid is inserted into a top opening of the container, and a pair of laterally spaced feet extending rearwardly from a bottom edge of the frame for engagement with an inner cylindrical surface of the container to prevent the grid from moving within the container during rolling of a roller cover on the wiping surface, wherein a pair of hooks extend rearwardly from opposite side edges of the frame in spaced relation from a bottom edge of the frame a distance slightly greater than the height of the container, whereby when the grid is inserted into the container top opening and the hooks are hooked over the container rim, the bottom edge of the frame and the feet will engage an inside bottom surface of the container, and wherein the wiping surface has an apertured portion that extends axially outwardly beyond the hooks, whereby when the grid is inserted into the container top opening and the hooks are hooked over the container rim, the apertured portion will extend upwardly above the container rim.

11. A paint roller grid comprising a wiping surface for wiping a roller cover thereagainst, and a pair of laterally spaced hooks extending rearwardly from the grid for hooking over an upper rim of a cylindrical container when the grid is inserted into a top opening of the container, each of the hooks including a rearwardly extending upper portion adapted to extend over an upper surface of the container rim and a downwardly extending inturned lip having a forwarding facing, laterally inwardly angled surface for engaging an outer cylindrical surface of the container below the container rim when the hooks are hooked over the container rim, the hooks being spaced from a bottom edge of the grid a distance slightly greater than the height of the container, whereby when the grid is inserted into the container top opening and the hooks are hooked over the container rim, the bottom edge of the grid will engage an inside bottom surface of the container, and a pair of laterally spaced feet extending rearwardly from a bottom edge of the grid for substantial flat engagement with the inside bottom surface of the container and with an inner cylindrical surface of the container to prevent the grid from moving within the container during rolling of a roller cover on the wiping surface, the feet extending rearwardly at a slight outward angle relative to respective side edges of the grid and have outwardly facing outer ends that engage the inner cylindrical surface of the container, the outer ends of the respective feet being angled rearwardly and inwardly for making contact with the inner cylindrical surface of the container, and the outer ends of the respective feet having a convex curvature for making increased contact with the inner cylindrical surface of the container.

12. A paint roller grid comprising a wiping surface for wiping a roller cover thereagainst, and a pair of laterally spaced hooks extending rearwardly from the grid for hooking over an upper rim of a cylindrical container when the grid is inserted into a top opening of the container, each of the hooks including a rearwardly extending upper portion adapted to extend over an upper surface of the container rim and a downwardly extending inturned lip having a forwarding facing, laterally inwardly angled surface for engaging an outer cylindrical surface of the container below the container rim when the hooks are hooked over the container rim, the wiping surface having an apertured portion that extends axially outwardly beyond the hooks, whereby when the grid is inserted into the container top opening and the hooks are hooked over the container rim, the apertured portion will extend upwardly above the container rim.

13. In combination, a cylindrical container having a closed bottom and a top opening surrounded by a container rim, and a paint roller grid inserted into the top opening of the container, the grid comprising a wiping surface for wiping a roller cover against the wiping surface, and a pair of laterally spaced hooks extending rearwardly from the grid hooked over the container rim, each of the hooks including a rearwardly extending upper portion extending over an upper surface of the container rim and a downwardly extending inturned lip having a forwardly facing, laterally inwardly angled surface engaging an outer cylindrical surface of the container below the container rim, the hooks being spaced from a bottom edge of the grid a distance slightly greater than the height of the container, whereby the bottom edge of the grid engages an inside bottom surface of the container, a frame extending completely around the wiping surface, and a pair of laterally spaced feet extending rearwardly from a bottom edge of the frame in substantial flat engagement with the inside bottom surface of the container and with an inner cylindrical surface of the container to prevent the grid from moving within the container during rolling of a roller cover on the wiping surface.

14. The combination of claim 13 wherein the hooks have an interference fit with the outer cylindrical surface of the container, whereby the inturned lip of the hooks is in a slightly flexed state pressing against the outer cylindrical surface of the container below the container rim.

15. In combination, a cylindrical container having a closed bottom and a top opening surrounded by a container rim, and a paint roller grid inserted into the top opening of the container, the grid comprising a wiping surface for wiping a roller cover against the wiping surface, and a pair of laterally spaced hooks extending rearwardly from the grid hooked over the container rim, each of the hooks including a rearwardly extending upper portion extending over an upper surface of the container rim and a downwardly extending inturned lip having a forwardly facing, laterally inwardly angled surface engaging an outer cylindrical surface of the container below the container rim, the wiping surface including an apertured portion that extends axially outwardly beyond the hooks, and a frame extending completely around the wiping surface, whereby the grid extends upwardly above the container rim to allow a handle of a roller frame to be hooked over an upper edge of the frame with the roller frame extending into the container for supporting a roller cover above the level of paint in the container.

* * * * *

UNITED STATES PATENT AND TRADEMARK OFFICE

CERTIFICATE OF CORRECTION

PATENT NO. : 7,137,168 B2
APPLICATION NO. : 10/643626
DATED : November 21, 2006
INVENTOR(S) : David G. Mann It is certified that error appears in the above-identified patent and that said Letters Patent is hereby corrected as shown below:

Column 4,
Lines 63, 64, replace “forwarding” with --forwardly--.

Line 67, replace “forwarding” with --forwardly--.

Column 5,
Lines 43, 51, replace “wining” with --wiping--.

Line 63, replace “wining” with --wiping--.

Column 6,
Lines 24, 25, replace “forwarding” with --forwardly--.

Lines 55, 56, replace “forwarding” with --forwardly--.

Signed and Sealed this

Twenty-fourth Day of April, 2007

JON W. DUDAS
*Director of the United States Patent and Trademark Office*